US009989064B2

(12) United States Patent
Klepsvik et al.

(10) Patent No.: US 9,989,064 B2
(45) Date of Patent: Jun. 5, 2018

(54) BALANCE PISTON FOR MULTIPHASE FLUID PROCESSING

(71) Applicant: OneSubsea IP UK Limited, London (GB)

(72) Inventors: Knut Harald Klepsvik, Kolltveit (NO); Åsmund Valland, Bønes (NO)

(73) Assignee: OneSubsea IP UK Limited, London (GB)

( * ) Notice: Subject to any disclaimer, the term of this patent is extended or adjusted under 35 U.S.C. 154(b) by 442 days.

(21) Appl. No.: 14/777,912

(22) PCT Filed: Mar. 18, 2014

(86) PCT No.: PCT/US2014/031046

§ 371 (c)(1),
(2) Date: Sep. 17, 2015

(87) PCT Pub. No.: WO2014/153345

PCT Pub. Date: Sep. 25, 2014

(65) Prior Publication Data

US 2016/0281726 A1 Sep. 29, 2016

Related U.S. Application Data

(60) Provisional application No. 61/802,830, filed on Mar. 18, 2013.

(51) Int. Cl.
*F04D 29/041* (2006.01)
*F04B 47/06* (2006.01)
(Continued)

(52) U.S. Cl.
CPC ..... *F04D 29/0416* (2013.01); *F04B 47/06* (2013.01); *F04D 3/00* (2013.01); *F04D 19/02* (2013.01); *F04D 29/0516* (2013.01)

(58) Field of Classification Search
CPC ..... F04D 29/0416; F04D 3/00; F04D 19/02; F04D 29/0516; F04B 47/06
See application file for complete search history.

(56) References Cited

U.S. PATENT DOCUMENTS 6,506,031 B2 * 1/2003 Sishtla ..... F04C 18/16 417/365
2010/0284829 A1 11/2010 Sloteman et al.
(Continued)

FOREIGN PATENT DOCUMENTS

DE 1528717 A 10/1969
EP 0570455 A1 11/1993
(Continued)

OTHER PUBLICATIONS

European Patent Application No. 14768808.9, extended European search report dated Mar. 24, 2017 (9 pages).
(Continued)

*Primary Examiner* — Richard Edgar
(74) *Attorney, Agent, or Firm* — Conley Rose, P.C.

(57) ABSTRACT

A rotating machine including a rotor operable to rotate about a centerline axis and subjected to axial thrust loads along the centerline axis during operation; a balance piston engaged with the rotor; a stator positioned around the balance piston and the rotor wherein a fluid passageway extends between the internal face of the stator and the external face of the balance piston; the fluid passageway including at least one cavity. A balance piston for a rotating machine including at least two segments arranged with a shift in diameter between each other.

32 Claims, 9 Drawing Sheets

(51) Int. Cl.

| | |
|---|---|
| ***F04D 3/00*** | (2006.01) |
| ***F04D 19/02*** | (2006.01) |
| ***F04D 29/051*** | (2006.01) |

(56) References Cited

U.S. PATENT DOCUMENTS

| | | | |
|---|---|---|---|
| 2012/0183388 | A1 | 7/2012 | Vannini et al. |
| 2012/0321438 | A1 | 12/2012 | Vannini et al. |

FOREIGN PATENT DOCUMENTS

| | | | |
|---|---|---|---|
| WO | 2009/135802 | A1 | 11/2009 |
| WO | 2011/078680 | A1 | 6/2011 |

OTHER PUBLICATIONS

International Patent Application No. PCT/US2014/031046 International Search Report and Written Opinion dated Aug. 20, 2014 (15 pages).

* cited by examiner

200

BALANCE PISTON FOR MULTIPHASE FLUID PROCESSING

CROSS-REFERENCE TO RELATED APPLICATIONS

This patent application claims the benefit of U.S. Prov. Ser. No. 61/802,830 filed Mar. 18, 2013, and entitled "A Rotating Machine and a Balancing Piston for a Rotating Machine," and International Application Ser. No. PCT/US2014/031046, filed Mar. 18, 2014, and entitled "Balance Piston For Multiphase Fluid Processing," the contents of each are hereby incorporated by reference in their entireties for all purposes.

TECHNICAL FIELD

The present disclosure relates generally to the use of a balance piston in rotating machines such as subsea pumps and subsea compressors. More particularly, the present disclosure relates to the use of a balance piston for achieving high differential pressures using a balance piston in subsea multiphase pumps and compressors.

BACKGROUND

Within rotating machines, thrust balancing of pressure forces has been a long-time design challenge for engineers. These challenges are becoming even more important now that rotating machines like pumps and compressors are being used under very demanding operating conditions.

Multiphase pumping on the seabed is gradually becoming a highly efficient way to produce deep offshore oil & gas fields. However, operators are now facing new challenges as the future subsea fields will be more difficult to produce due to remote locations, increased water depth, and higher viscosity of the process fluids. There is currently an increasing demand from the industry to develop pumping systems with larger boosting capabilities. However, known multiphase pump technology generally has a maximum differential pressure of 725 psi (50 bar).

Boosting of the unprocessed well fluids is done in order to enable or enhance oil production from subsea wells. To boost the production, the pumps or compressors may be located in the production line on the seabed. The pumps (single, multiphase or a hybrid) will thereby reduce the wellhead pressure and hence increase oil production rate and recovery.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a subsea fluid processing machine is described that is configured to process a multiphase subsea process fluid. The machine includes: a stationary machine body configured for deployment in a subsea location; and a multiphase fluid inlet and a multiphase fluid outlet, each of which are formed at least partially within the machine body. The machine further includes at least one rotating member configured to rotate about a vertically-oriented central axis, thereby inducing a pressure differential of the multiphase process fluid between the inlet and outlet and imparting a reactionary force on the rotating member in a downwards direction. A rotating balance piston member is in a fixed relationship with the rotating member and includes a first lower surface area exposed to a first volume of the multiphase process fluid and a second upper surface area exposed to a second volume of the multiphase process fluid. The first and second volumes are configured such that while the rotating member is rotating, fluid pressure in the first volume is higher than in the second volume, which imparts a force on the rotating member in an upwards direction. The machine also includes a balance piston fluid channel defined by an outer surface of the rotating balance piston member and an inner stationary surface in a fixed relationship with the stationary machine body. The balance piston fluid channel has a channel inlet to the first volume and a channel outlet to the second volume.

According to some embodiments, the balance piston fluid channel is shaped so as to minimize fluid-induced transient load (radial and/or axial in direction) on the balance piston while in operation. The balance piston fluid channel can have a diameter through the central axis that decreases in length from the channel inlet to the channel outlet. In some examples, the balance piston channel includes a first lower cylindrical section having a first diameter through the central axis, and a second upper cylindrical section having a second diameter through the central axis. In such cases, the second diameters are of different lengths. In some cases the second diameter is shorter than the first diameter. In other cases the first diameter is shorter than the second diameter. According to some embodiments the difference between the first and second diameters is less than 20 mm. According to some preferred embodiments, the difference between the first and second diameters is within a range of 4-6 mm. The inner stationary surface and the outer surface of the balance piston each can include first and second cylindrical sections corresponding to the diameters of the first and second sections of the balance piston channel. According to some embodiments, the first and second cylindrical sections of the inner stationary surface each includes a plurality of cylindrical sub-sections having successively shorter diameters. In some examples, the balance piston includes a ring-shaped cavity positioned between the first and second cylindrical sections. A swirl brake structure can be formed within the ring-shaped cavity. A swirl brake can also be formed at the channel inlet of the balance piston channel.

According to some embodiments, the inlet of the balance piston channel and the first volume of the multiphase fluid form an integral part of a primary flow path from a final diffuser stage to the processing machine outlet. According to some embodiments, the machine is a helico-axial multiphase pump. According to some other embodiments, the machine is a multiphase compressor. According to some embodiments, the balance piston is positioned above a plurality of impeller stages, and according some other embodiments, the balance piston is positioned below the plurality of impeller stages. According to yet other embodiments, two balance pistons can be provided with one above and one below the set of impeller stages.

According to some embodiments, a method is described for processing a multiphase fluid using a processing machine in a subsea location. The method includes: in a subsea location, rotating a rotating member about a vertically-oriented central axis within a stationary machine body thereby inducing a pressure differential between a machine inlet and a machine outlet, and imparting a reactionary force on the rotating member in a downwards direction. A balance piston is rotated with the rotating member. The piston includes a first lower surface area exposed to a first volume of the multiphase fluid and a second upper surface area exposed to a second volume of the multiphase fluid. The first and second volumes are configured such that a corresponding pressure differential is induced with the first volume fluid pressure being greater than the second volume fluid pressure. A counteracting force is thereby imparted on the rotating member in an upwardly direction.

According to some embodiments, the machine is a helico-axial design in which a plurality of rotating impeller stages are interleaved with a plurality of static diffuser stages. According to some embodiments, the induced differential pressure between the machine inlet and outlet is greater than 100 bar, and the multiphase fluid has a gas volume fraction of greater than 20%. According to some embodiments, the gas volume fraction is greater than 40% and according to yet some other embodiments, the gas volume fraction is greater than 50%.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only, and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure; the description taken with the drawings making apparent to those skilled in the art how the several forms of the subject disclosure may be embodied in practice. Further, like reference numbers and designations in the various drawings indicate like elements.

Figure 1:
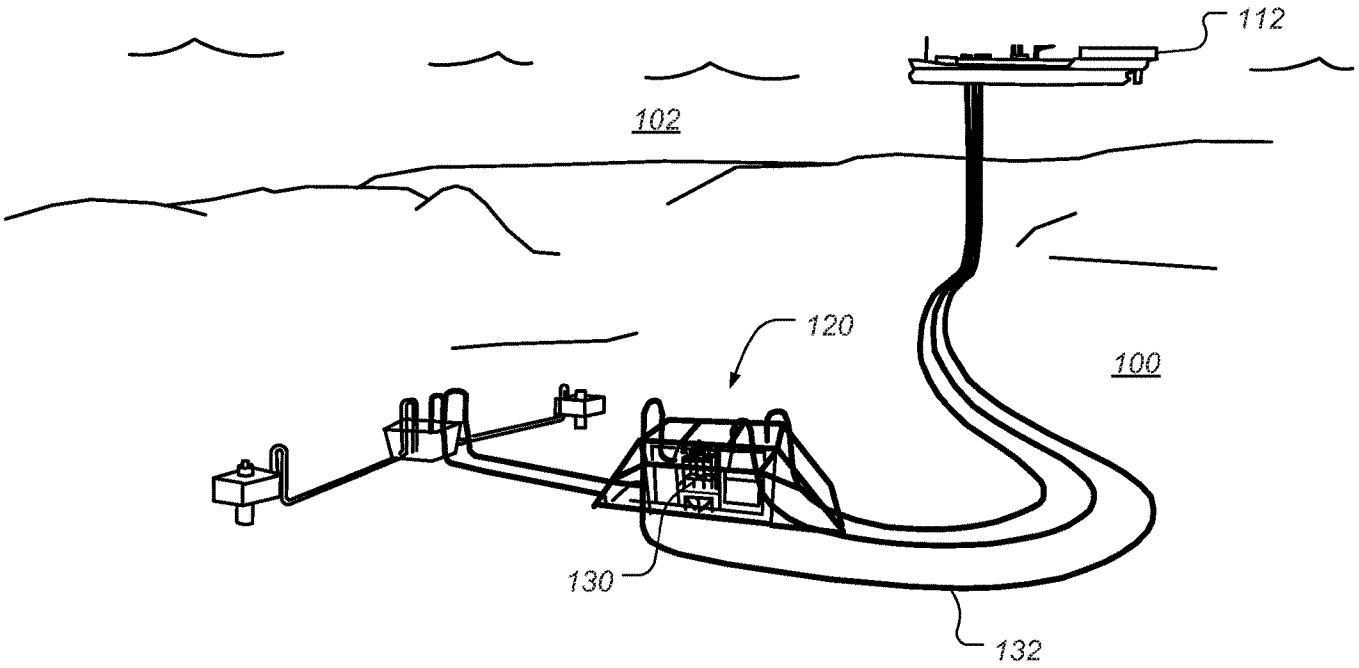
FIG. 1 is a diagram illustrating a subsea environment in which a multiphase production fluid is being pumped or compressed, according to some embodiments.

FIG. 1 is a diagram illustrating a subsea environment in which a multiphase production fluid is being pumped or compressed, according to some embodiments. On sea floor 100 a subsea station 120 is shown which is downstream of several wellheads being used, for example, to produce multiphase hydrocarbon-bearing fluid from a subterranean rock formation. Subsea station 120 includes a subsea multiphase pump unit or subsea multiphase compressor unit 130. The subsea station 120 is connected to one or more umbilical cables, such as umbilical 132. The umbilicals in this case are being run from a floating production, storage and offloading unit (FPSO) 112 through seawater 102, along sea floor 100 and to station 120. In other cases, the umbilicals may be run from some other surface facility such as a platform, or a shore-based facility. In addition to pump/compressor unit 130, the station 120 can include various other types of subsea equipment. The umbilical 132 is used to supply barrier fluid for use in the subsea pump or compressor (which includes an oil-filled electric motor). Further, umbilical 132 provides electrical power to station 120. According to some embodiments, the umbilicals also provide other functionality such as: data transmission (e.g. control signals from the surface to the station, as well as data from the station to the surface); and energy to the station in other forms (e.g. hydraulic).

Figure 2:
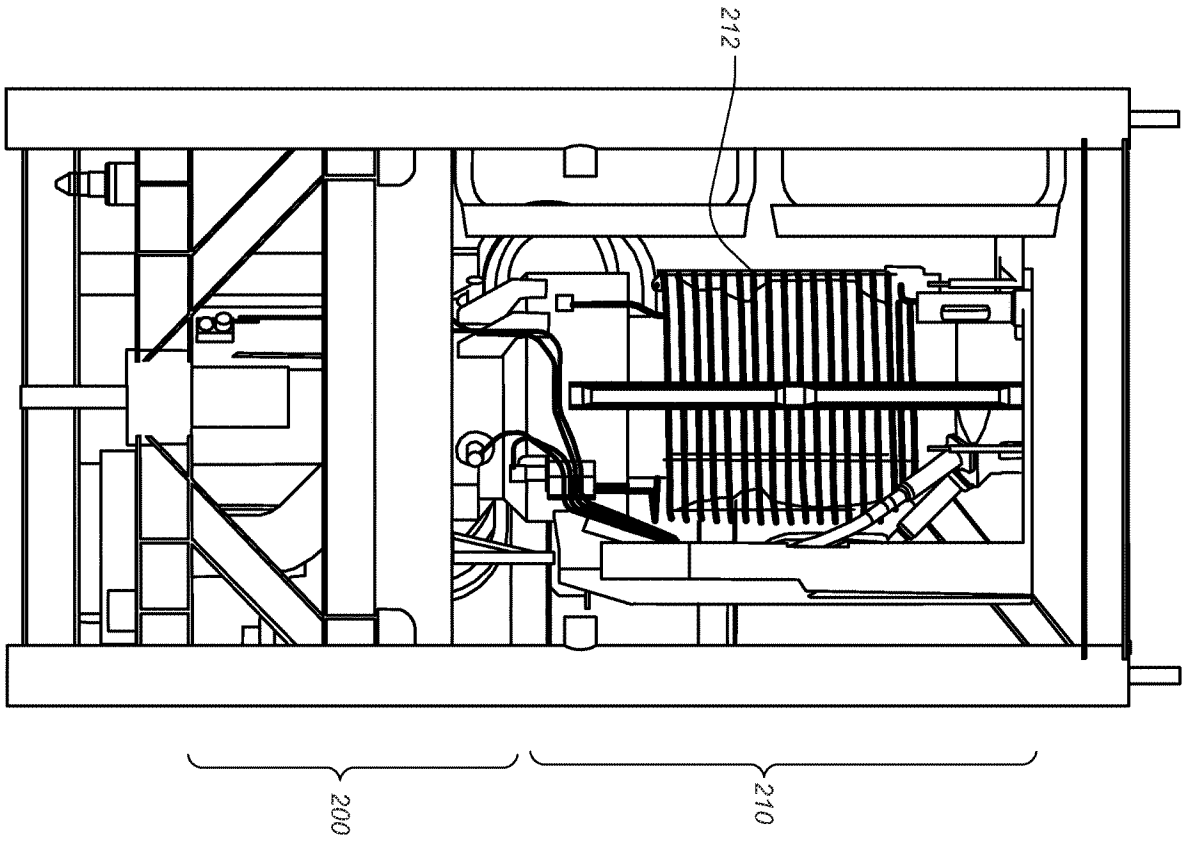
FIG. 2 is a diagram illustrating a subsea pump/compressor configured to process multiphase fluid in a subsea environment, according to some embodiments.

FIG. 2 is a diagram illustrating a subsea pump/compressor configured to process multiphase fluid in a subsea environment, according to some embodiments. Note that throughout this disclosure, subsea multiphase pump 200 is referred to as a "pump" and in many of the figures a multiphase pump is depicted. However, according to some embodiments analogous structures and techniques are applied to a subsea multiphase compressor. Thus according to such embodiments, a subsea multiphase compressor is substituted in place of the described and/or depicted subsea multiphase pump. Similarly, the terms "pump/compressor" as used herein refers to a pump (such as shown in many of the figures) a well as to a compressor (which can be substituted for a pump). Subsea pump/compressor unit 130 includes a subsea multiphase pump 200 driven by a subsea motor 210. According to some embodiments, subsea motor 210 is an oil-filled motor that is supplied with barrier fluid via an umbilical from the surface (as shown in FIG. 1). According to some embodiments, motor 210 also includes a circumferentially-arranged barrier fluid cooling coil 212.

For subsea multiphase pumps and compressors, such as pump/compressor 200, design considerations generally span a wider range than that commonly considered for conventional single-phase pumps or compressors. Examples of additional challenges include those related to the varying Gas Volume Fraction (GVF), viscous multiphase fluid, expansion of the gas phase over the balance piston, leakage rates, heat generation, and rotordynamics during the various operating conditions.

Figure 3:
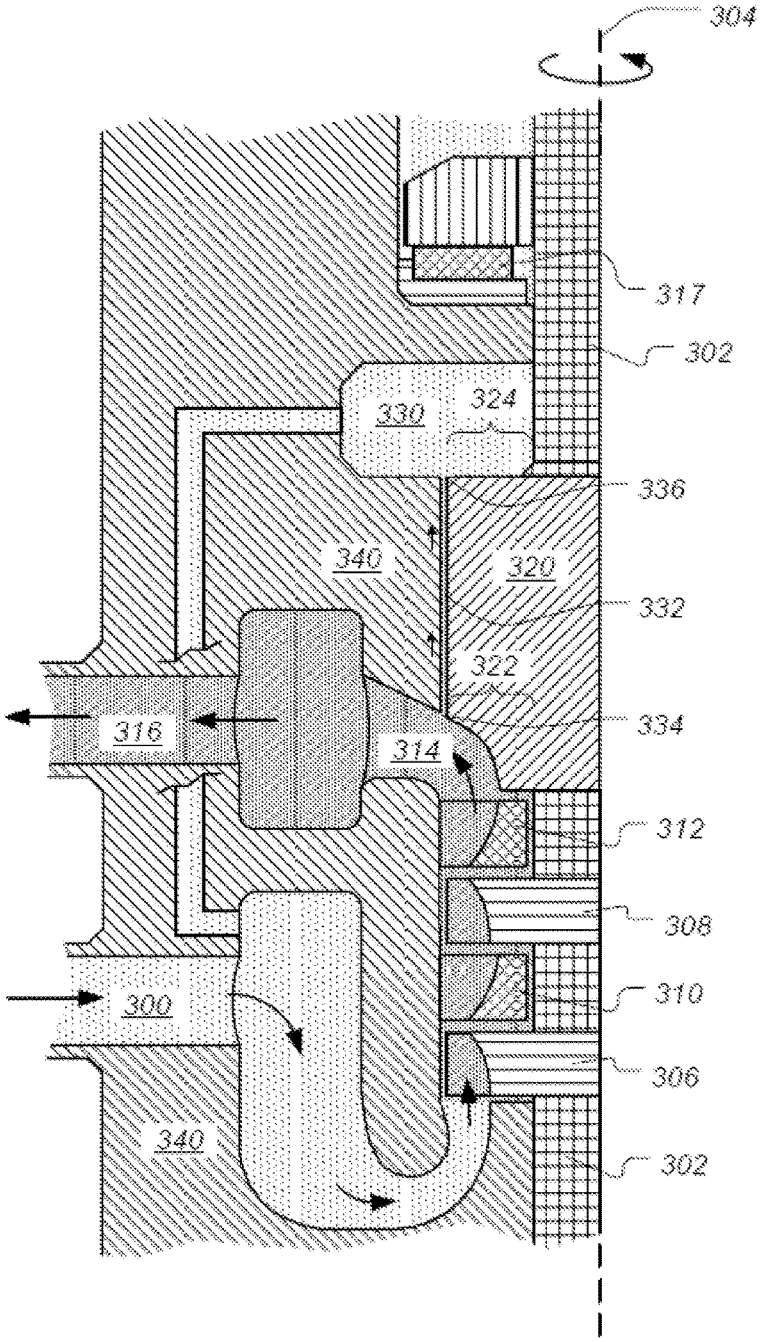
FIG. 3 is a diagram illustrating aspects of a subsea pump/compressor configured to process multiphase fluid in a subsea environment, according to some embodiments.

FIG. 3 is a diagram illustrating aspects of a subsea pump/compressor configured to process multiphase fluid in a subsea environment, according to some embodiments. Subsea multiphase pump 200 is shown in this simplified diagram. Multiphase pump 200 is a helicon-axial design and includes an inlet 300 where the multiphase fluid enters. The pump shaft 302 is driven by a subsea motor (such as motor 210 shown in FIG. 2) such that shaft 302 rotates about central axis 304. Impeller stages 306 and 308 are fixed to the pump shaft 302 and act to apply tangential velocity on the fluid, while the interleaved static diffuser stages 310 and 312 convert the tangential velocity into axial velocity. Although for purposes of clarity only two impeller and two diffuser stages are shown, in practice greater numbers of alternating impeller and diffuser stages are used. In region 314 the multiphase fluid exits the last diffuser stage 312 and moves towards the pump outlet 316.

The axial force due to the thrust load of the impeller stages is a major challenge in the design of a multiphase pump that provides a high differential pressure. If all the impellers of the multistage pump 200 face in the same direction, the total theoretical hydraulic axial thrust acting towards the suction end of the pump (i.e. downwards in FIG. 3) will be the sum of the thrust from the individual impellers. The resultant axial force must be counteracted mechanically and/or hydraulically. The thrust bearing 317 is designed to absorb some of the thrust load. However, for relatively high differential pressures, such as greater than 725 psi (50 bar), the forces in question relying on thrust bearing 317 alone would make bearing 317 be out of proportion structurally. Additionally, it has been found that the rotordynamic effects of such unbalanced resultant forces are often unacceptable.

According to some embodiments, a balance piston 320 is used to counteract the resultant thrust force for high differential pressure multiphase pumps and/or compressors. It has been found that conventional design rules for balance pistons used in single-phase pumps and compressors were insufficient. The operating conditions of the balance piston for a multiphase pump or compressor are simply not comparable with the conventional design requirements for a single-phase liquid pump.

According to some embodiments, multiphase pump 200 includes a balance piston 320 that has been designed so as to be tolerant to the rigors associated with multiphase fluids. It has been found that such balance piston designs can enable multiphase pumps to generate higher differential pressures than would otherwise be feasible. According to some embodiments, a balance piston design is used to enable differential pressures in a multiphase pump or compressor beyond 200 bars.

Balance piston 320 is fixed to the pump shaft 302 and has a lower surface 322 that is exposed to the higher pressure multiphase fluid in region 314 as well as an upper surface 324 that is exposed to the lower pressure multiphase fluid in ring-shaped volume 330. Note that volume 330 is in fluid communication with the pump inlet 300 via a relatively wide conduit. The pressure differential between regions 314 and 330 on the exposed surfaces 322 and 324 act to induce an upwards force on balance piston 320 which partially counterbalances the thrust forces being generated by the impeller stages. A narrow balance piston channel 332 is defined by the small gap between the outer surface of balance piston 320 and the inner surface of pump housing 340, as shown. The balance piston channel 332 has an inlet 334 from region 314 and an outlet 336 to volume 330, as shown.

In designing the diameter of the balance piston, two primary constraints should be considered. The diameter should be selected in order to limit the thrust forces at high differential pressures. From this constraint a minimum diameter can be identified. The other constraint is to avoid negative thrust forces, which can potentially appear when operating at lower differential pressures. From this constraint a maximum diameter can be identified.

In order to secure reliable rotordynamics and avoid axial movement of the shaft, a positive residual thrust should be assured over the full operating envelope of the pump. According to some embodiments, a balance piston diameter can be selected in the upper part of the allowable diameter range in order to provide a margin on thrust forces at high differential pressures, and also to allow for potentially differential pressures greater than base case limits.

Figure 4:
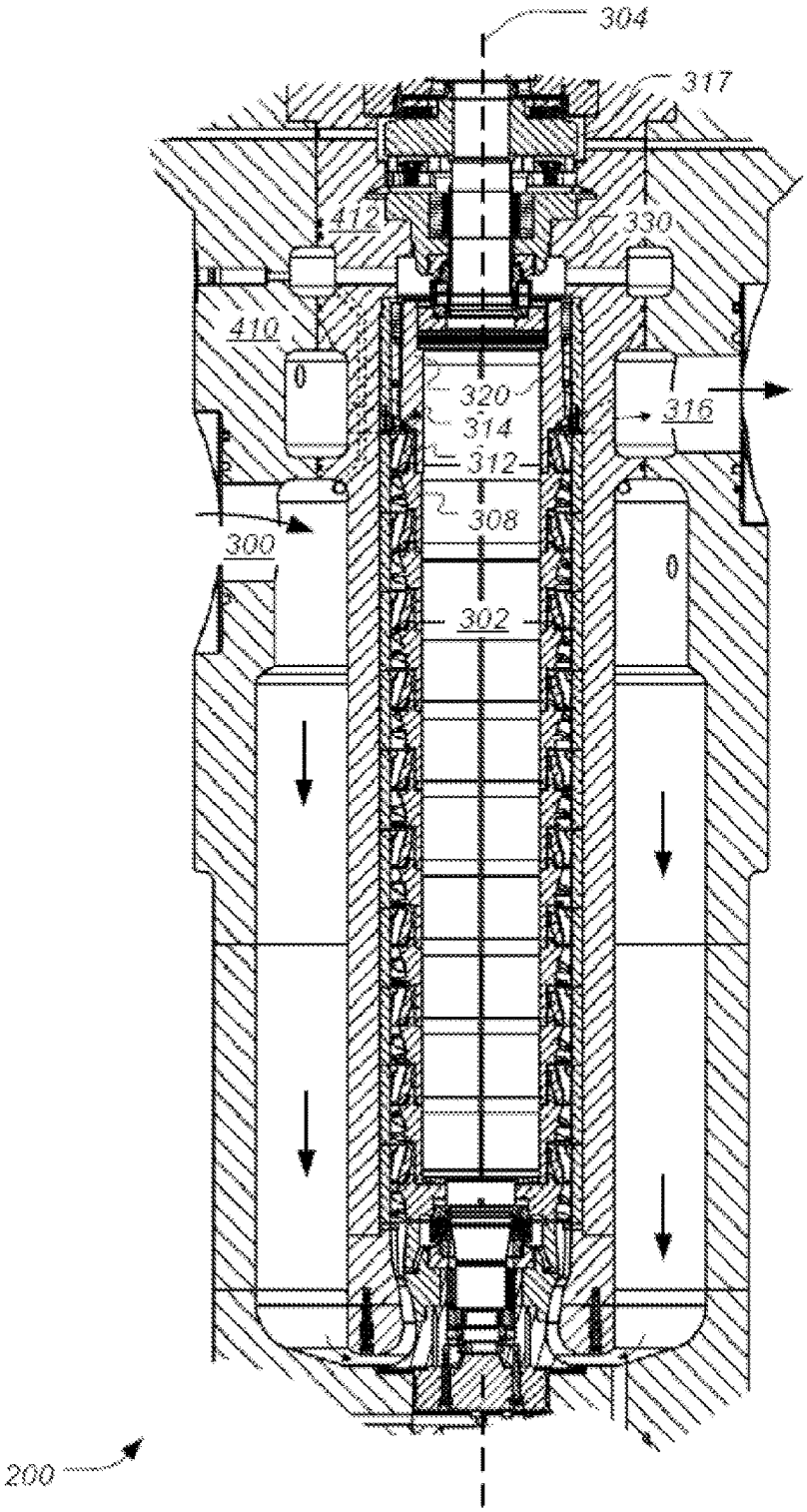
FIG. 4 is a cross-section view illustrating further details of a subsea pump/compressor configured to process multiphase fluid in a subsea environment, according to some embodiments.

FIG. 4 is a cross-section view illustrating further details of a subsea pump/compressor configured to process multiphase fluid in a subsea environment, according to some embodiments. The cross section of FIG. 4 is a less simplified view than in FIG. 3 of pump/compressor 200. A greater number of alternating impeller and diffuser stages can be seen in the helico-axial pump 200. The static housing of the pump includes an outer mixer housing 410 and an inner pump housing 412. Note that the ring-shaped upper volume 330 directly above the balance piston 320 is in fluid communication with the pump inlet 300, as indicated by dotted lines. Also, the region 314 just downstream of the final static diffuser stage 312 is in fluid communication with the pump outlet 316 as indicated by the dotted lines.

Figure 5:
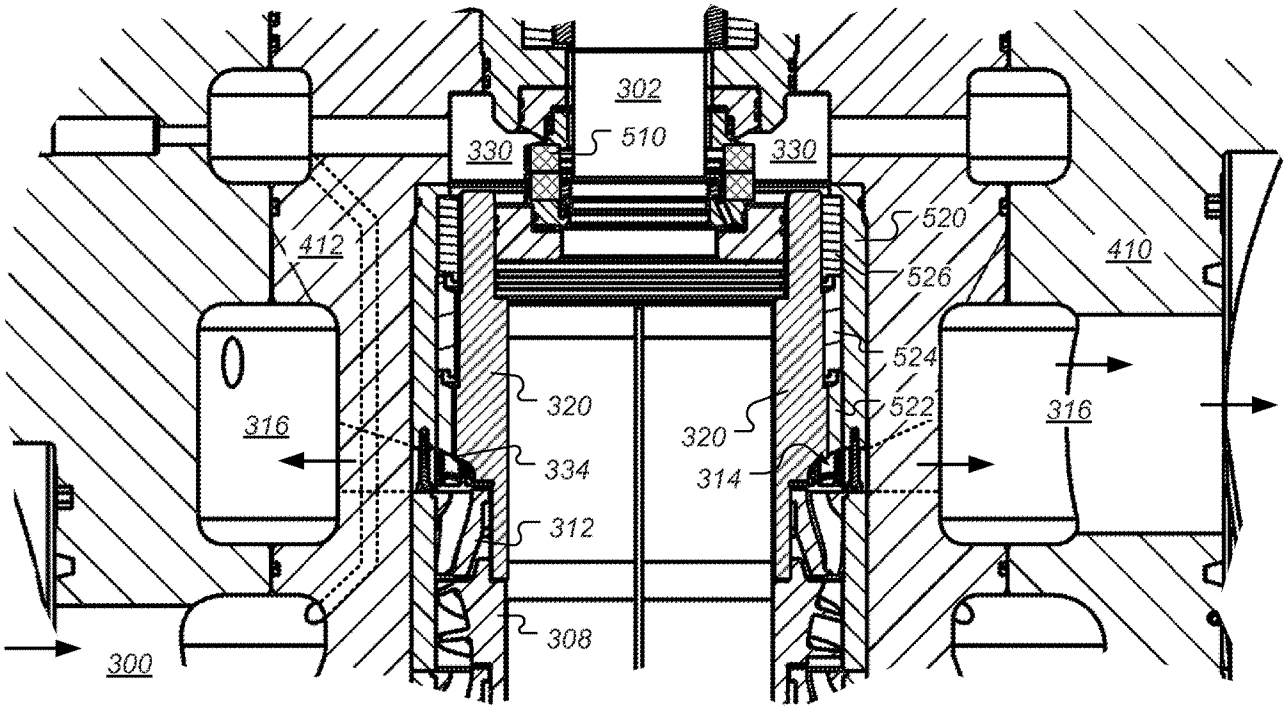
FIG. 5 is a cross-section view illustrating even further details of a subsea pump/compressor configured to process multiphase fluid in a subsea environment, according to some embodiments.

FIG. 5 is a cross-section view illustrating even further details of a subsea pump/compressor configured to process multiphase fluid in a subsea environment, according to some embodiments. Visible in FIG. 5 are the upper set of dynamic seals 510. Also visible fixed to the pump housing 412 is a sleeve 520 and three sections 522, 524 and 526 that form the static outer surface of the balance piston channel (with the inner surface being the exterior of the balance piston 320). According to some embodiments, as will be described in greater detail herein, the diameter of balance piston is variable and decreases from the channel inlet to the channel outlet. In the case shown in FIG. 5, the balance piston has three distinct diameters with the step changes between diameters coinciding with the interface between each of the static sleeve sections 522, 524 and 526.

An important design goal for balance piston designs in multi-phase pumps is fluid leakage loss through the balance piston channel. According to some embodiments, fluid leakage rates though the balance piston channel is less than 10 percent of the main flow for operation at the expected differential pressures and for the expected level of gas volume fraction (GVF) of the fluid. Another important and related design goal is that the pump should be able to run at high speed at a low differential pressure, without risk of high temperatures or rotordynamic instabilities due to low flow rate through the balance piston. In a conventional single-phase pump or compressor, the leakage rate through the balance piston is controlled primarily though the following parameters: length, diameter, clearance and wall surface roughness. However, for multiphase flow pumps and compressors, the volumetric leakage rates change significantly with the level of GVF of the fluid due to the different densities and viscosities of the phases. Several effects have been identified as a consequence of operating at different GVF's. A significant benefit of minimizing the GVF through the balance piston channel is to reduce leakage rates. On the other hand, the liquid-rich part of a multiphase fluid also includes the majority of particles in the fluid and this can lead to undesirable wear rates. By maximizing the GVF in the balance piston, the risk of particles can be negligible but the leakage rates can be unacceptable during normal operation. According to some embodiments, the design goal is therefore to achieve the same GVF in the balance piston as for the main flow in the multiphase pump. From a thermodynamic point of view this is also beneficial as fluid flow past the balance piston will be maintained at all operating conditions. This provides cooling even in extreme operating conditions with pure gas/low differential pressure as well as with low GVF/high differential pressure. Regarding surface texture, it has been found that both hole type patterns or honeycomb type designs lead to particle accumulation or liquid accumulation, with only marginal benefits. Therefore, according to some embodiments a smooth wall surface is used to ensure a robust design.

To identify where best to place the balance piston inlet, CFD calculations can be performed to simulate the balance piston inlet, and to determine the liquid holdup and particle path through the pump outlet section. For further details of such calculations, see Bibet, P., Lumpkin V. A, Klepsvik K. H., and Grimstad H. 2013, "Design and verification testing of new balance piston for high boost multiphase pumps." In *Proceedings of the Twenty-Ninth International Pump Users Symposium*, Oct. 1-3, 2013, Houston, Tex., which is incorporated by reference herein.

Figure 9:
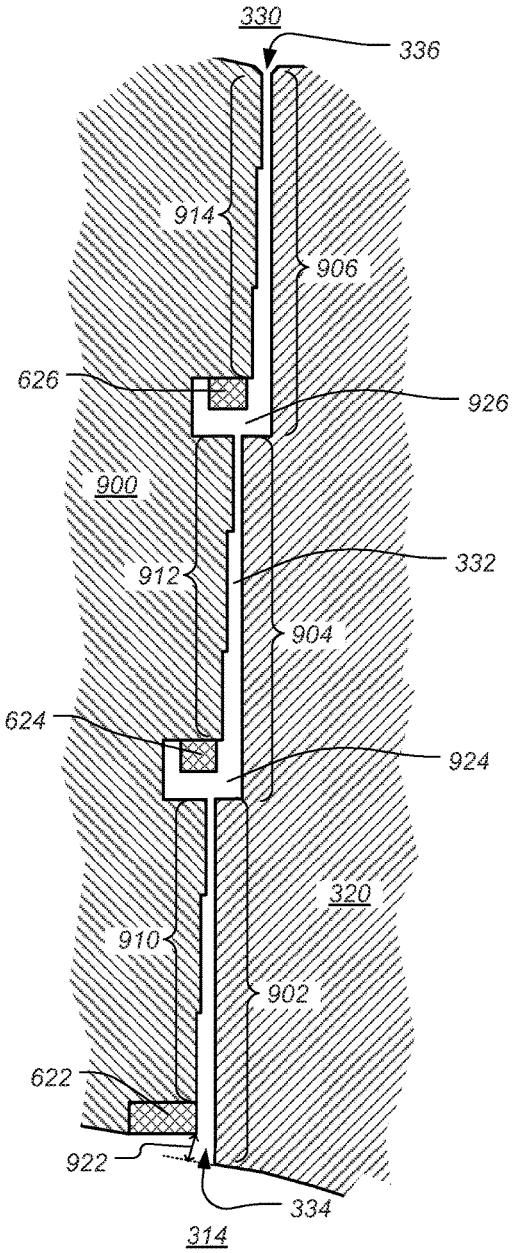
FIG. 9 is a cross section showing a balance piston channel for subsea multiphase pumps and compressors, according to some embodiments.

Another important design goal for balance piston designs in multi-phase pumps is wear resistance and tolerance to particles and deposits in the multiphase fluid stream. Materials should be selected to maximize wear resistance. According to some embodiments, static parts, such as static sleeve sections 522, 524 and 526 are made of solid tungsten carbide, while rotating surfaces, such as balance piston 320 is coated with tungsten carbide. However, it has been found that it is insufficient to only look at the balance piston design with respect to achieving 100% wear mitigation. The number of particles entering the balance piston should also be minimized to reduce wear. Therefore a study of flow conditions upstream the balance piston (e.g. in region 314) was used to address this issue. Using CFD calculations, according to some embodiments a design for minimizing wear includes taking advantage of the centrifugal forces in the fluid swirl just downstream the last impeller. The fluid swirl combined with the selected diffuser design can ensure a high particle concentration at the external diameter of the flow path. Using such a design, it has been found that the majority of the particles pass by the balance piston inlet 334 and follow the main stream into the pump outlet 316. According to some embodiments, additional wear-resistance and particle tolerance can be achieved by designing a small step 922 between the lower edge of balance piston 320 and the static structure (section 522 and/or swirl brake 622) as shown in FIG. 9 which is described in further detail, infra.

Figure 6:
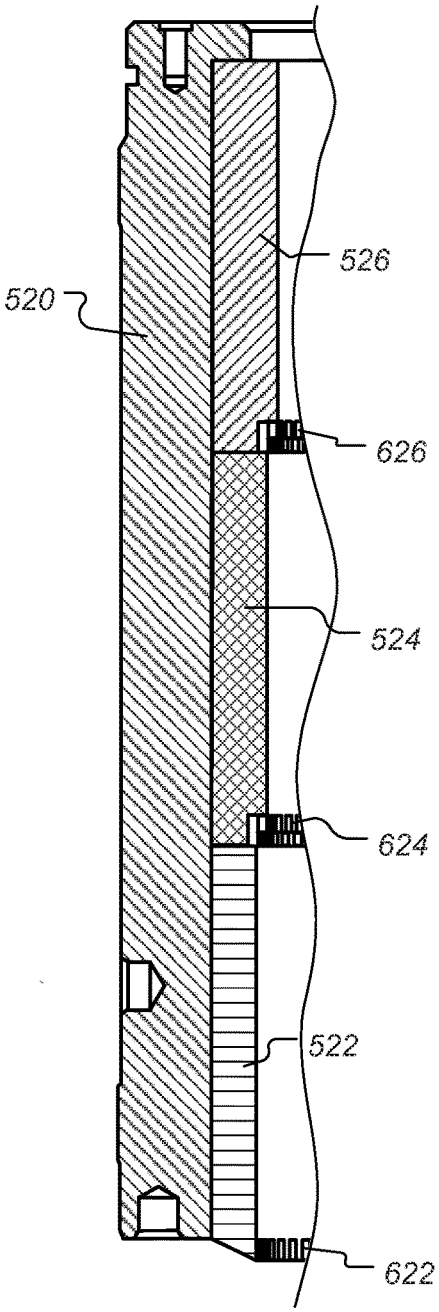
FIG. 6 is a partial cross section showing further details of a static side of a balance piston used for subsea multiphase fluid pumps and compressors, according to some embodiments.

FIG. 6 is a partial cross section showing further details of a static side of a balance piston used for subsea multiphase fluid pumps and compressors, according to some embodiments. Visible in FIG. 6 is static sleeve 520 and three sections 522, 524 and 526 that form the static outer surface of the balance piston channel (with the inner surface being the exterior of the balance piston 320, not shown). As described, supra, the diameter of the balance piston is variable and decreases from the channel inlet to outlet. In the case shown in FIG. 6, the balance piston and has three distinct diameters with the step changes between diameters coinciding with the interface between each of the static sleeve sections 522, 524 and 526. The largest diameter is on section 522, followed by section 524, and the smallest diameter is on section 526. It has been found that tapering the diameter of the balance piston significantly increases wear resistance, as well as provides superior rotordynamic behavior with multiphase fluid. According to some embodiments, the difference in diameter between each successive section ranges from 0-20 millimeters. According to some preferred embodiments, the difference in diameter between each successive section is about 4-6 millimeters.

Also visible in FIG. 6 are swirl brakes 622, 624 and 626 formed on the upstream end of the sections 522, 524 and 526 respectively. The conventional methods used in designing single-phase pumps for selecting a swirl brake design were found to be unacceptable. The conventional single-phase swirl brake designs were found to be overly vulnerable to erosion and abrasion for subsea multiphase fluid applications. A separate study was performed focusing on a new swirl brake design to avoid thin walled swirl brake segments, but still achieving the required swirl control.

Figure 7:
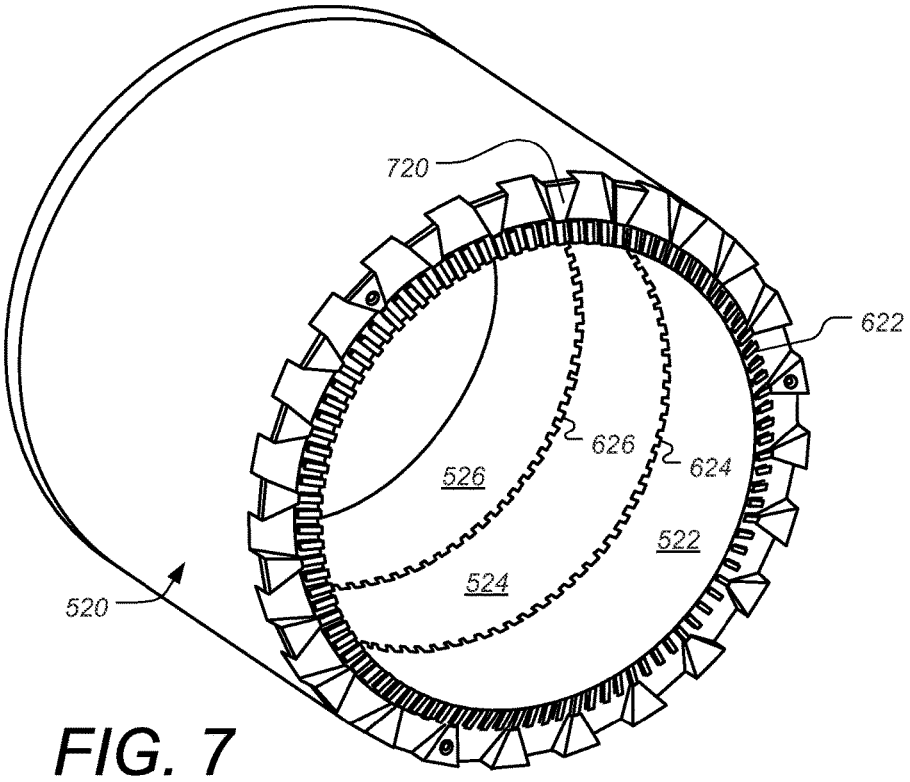
FIG. 7 is a prospective view showing further details of the static portion into which a balance piston used with a multiphase pump and/or compressor is used, according to some embodiments.
Figure 8:
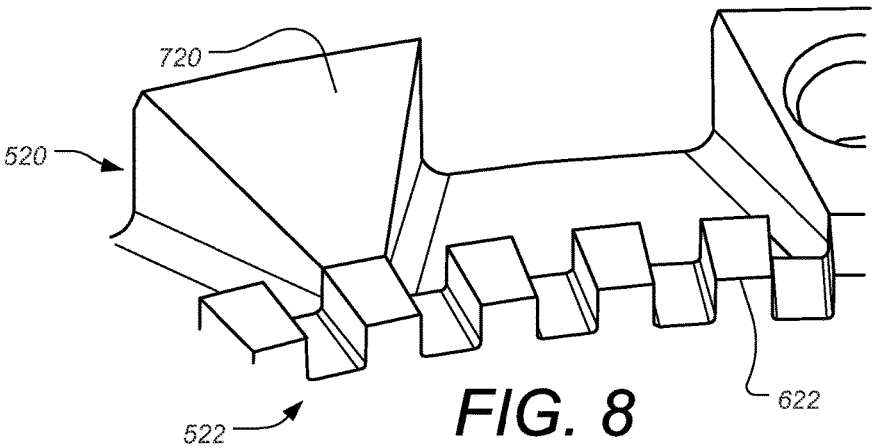
FIG. 8 is a prospective view showing even further detail of the leading swirl brake on the static portion into which a balance piston used with a multiphase pump and/or compressor is used, according to some embodiments.

FIG. 7 is a prospective view showing further details of the static portion into which a balance piston used with a multiphase pump and/or compressor is used, according to some embodiments. Visible in FIG. 7 are the swirl brakes 622, 624 and 626 formed on the upstream end of the sections 522, 524 and 526 respectively, as well as sleeve 520. Note that the tapered ramp portions 720 on the end of sleeve 520 are shaped to aid in directing the main multiphase fluid flow path towards and through a plurality of conduits leading from region 314 to the pump outlet 316 (shown in FIGS. 4 and 5). FIG. 8 is a perspective view showing even further detail of the leading swirl brake on the static portion into which a balance piston used with a multiphase pump and/or compressor is used, according to some embodiments. It has been found that the swirl brake design as shown in FIGS. 6-8 (as well as FIGS. 9-10, infra.) are able to meet the goals of erosion control and abrasion resistance without compromising the swirl control. According to some embodiments, a swirl factor of zero can be achieved for several operating conditions.

Another important design goal for multiphase pumps using a balance piston is ensuring stable rotordynamic performance of the balance piston, and to minimize the effects of the balance piston on the whole rotor assembly when operating at any of the specified conditions over the full range of fluid mixtures. Due to the relatively large dimensions of the balance piston, its rotordynamic parameters could have a significant impact on the shaft-bearing system. According to some embodiments, the balance piston 320 can be made an integral part of the pump shaft 302, and according to other embodiments, the piston 320 can be mounted on the shaft 302 as a sleeve.

In balance piston designs, it is fluid induced forces that often dominate the rotordynamic performance. With the large range of possible fluid compositions, gas volume fractions and differential pressures, a correspondingly large variation of rotordynamic performance is considered. In addition, the requirements for thrust balancing and leakage rate control often results in a relatively large length/diameter (L/d) ratio for the balance piston in the multiphase application. For example, for many applications a L/d ratio of almost 1 is desirable for the balance piston.

It has been found that typical bulk flow simulation models are unsuitable for simulating multiphase fluids or complex geometries in many balance piston designs. Therefore according to some embodiments, CFD based simulation tools were used to validate and optimize both the various designs. With respect to rotordynamic stability, a design goal for the balance piston is to reduce the large cross-coupled stiffness that is typical for high L/d ratios, and to increase the direct stiffness by the means of clearance profiles and balance piston inlet design. After verifying the inlet conditions, a validation of the swirl brake design can be carried out by simulating the local flow pattern around a set of swirl brake teeth. A well-designed inlet with a swirl factor close to zero maximizes the Lomakin effect and hence contributes to optimized direct stiffness for the balance piston.

FIG. 9 is a cross section showing a balance piston channel for subsea multiphase pumps and compressors, according to some embodiments. Visible is balance piston channel 332 that is defined by the static side 900 and the balance piston 320. According to some embodiments, a remedy for the adverse effects of the high L/d ratio of the balance piston is to effectively split the piston into three independent segments, thereby achieving a lower effective L/d ratio for each of the segments. As the cross-coupled forces increase with a factor of approximately three with increasing L/d, it is beneficial to have three balance pistons of reduced L/d rather than one balance piston with greater L/d. In the example of FIG. 9, the segments are defined as rotordynamically independent due to a cavities 924 and 926, that include swirl brakes 624 and 626 respectively, implemented between each segment. The cavities 924 and 926 have been found to stabilize the pressure field in the circumferential direction and hence suppress the Bernoulli effect. Also visible in FIG. 9 are decreasing diameters of balance piston 320 in regions 902, 904 and 906, and static side sections 910, 912 and 914. Furthermore, according to some embodiments, the static sections 910, 912 and 914 are each further tapered by including three distinct diameters as shown in FIG. 9. As the balance piston now has effectively three independent segments, it also effectively has three inlets with low swirl factor. This results in a direct stiffness that is almost three times higher than for a balance piston with only one segment.

Figure 10:
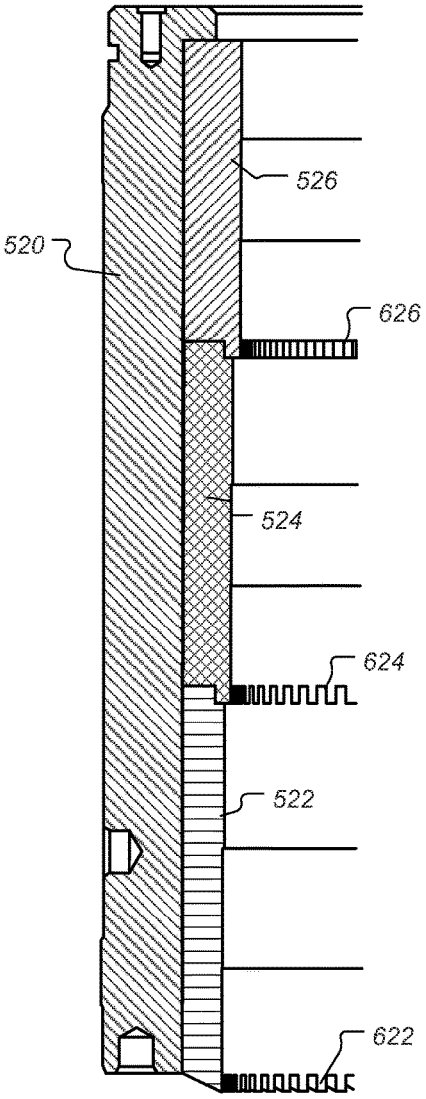
FIG. 10 is a cross section showing further details of a static sleeve and sections used with a balance piston equipped multiphase pump or compressor, according to some embodiments.

FIG. 10 is a cross section showing further details of a static sleeve and sections used with a balance piston equipped multiphase pump or compressor, according to some embodiments. In the example of FIG. 10, each of the static sections 522, 523 and 526 has three different diameters as shown. According to some embodiments, the difference in diameters within each of the sections is between 0 and 5 mm. Note that although the static and rotary portions of the balance piston have been shown in decreasing diameters of three primary steps (and in some case nine smaller steps), other numbers of steps are contemplated and may be useful depending on the other design parameters and expected operating conditions.

According to some embodiments, the slight shift in diameter for each segment effectively forces the velocity profile from the upstream segment to be suppressed and routed into the swirl brakes. In some embodiments, the inlet design with a swirl factor close to 0 or even a negative swirl, maximizes the Lomakin effect and hence contributes to direct stiffness for the balance piston. According to some other embodiments, the balance piston comprises a single segment and the clearance of passageway between the external face of the balance piston and the internal face of the stator is made convergent to force flow of fluid from the inlet and to increase the direct stiffness. Said clearance can contain one or a plurality of swirl brakes. Said clearance might also contain one or more cavities wherein swirl brakes can be installed. Further, the swirl brake and cavities significantly reduce or prevent fluid separation, and particle accumulation.

With a homogenous multiphase fluid entering the balance piston channel the fluid is exposed to significant centrifugal forces that can result in phase separation after a given axial distance into the channel. The liquid phase is forced out to a high diameter such that it is mainly covering the static surface. The light gas phase, on other hand, mainly covers the inner rotating surface. This effect increases with increasing liquid viscosity as the Reynolds number is reduced and laminar flow can be expected. There are several disadvantages of this phenomenon including non-linear stiffness effects. For a given level of shaft eccentricities the rotating surface will "hit" the liquid rich area and will suddenly be exposed to a fluid with totally different viscosity and density. This can give a step change, especially in cross-coupled stiffness, and can result in uncontrolled rotordynamic behavior. According to some embodiments, these negative effects are alleviated by controlling the multiphase fluid mix and ensuring a more homogenous mixture. According to some embodiments, each segment is made short enough to avoid significant phase separation and the intermediate swirl brakes and the swirl brake cavities ensure good fluid mixing before the fluid enters the next segment.

According to some embodiments, the balance piston only has one segment. To further increase fluid mixture control, the balance piston channel (between the balance piston external face and the stator internal face) profile is made converging with a stepped profile. The converging channel design enables enhanced direct stiffness, and the stepped design is adding an additional mixing effect. The stepped design of the passageway can come from the segmented piston, the stepped internal face of the stator, or both.

Figure 11:
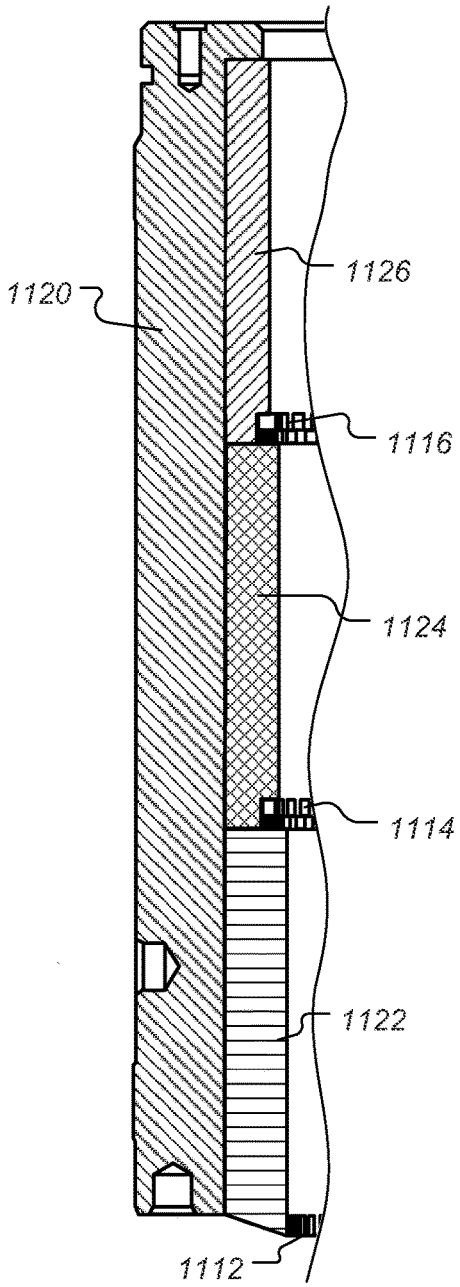
FIG. 11 is a partial cross section showing further details of a static side of a balance piston used for subsea multiphase fluid pumps and compressors, according to some embodiments.

FIG. 11 is a partial cross section showing further details of a static side of a balance piston used for subsea multiphase fluid pumps and compressors, according to some embodiments. As in the embodiments of FIGS. 6, 7 and 10 the static sleeve 520 and three sections 1122, 1124 and 1126 that form the static outer surface of the balance piston channel (with the inner surface being the exterior of the balance piston 320, not shown). However in the case of FIG. 11, the diameter of the balance piston is variable and increases (rather than decreases) from the channel inlet to outlet. In the case shown in FIG. 11, the balance piston and has three distinct diameters with the step changes between diameters coinciding with the interface between each of the static sleeve sections 1122, 1124 and 1126. The smallest diameter is on section 1122, followed by section 1124, and the largest diameter is section 1126. According to some embodiments, the difference in diameter between each successive section ranges from 0-20 millimeters. According to some preferred embodiments, the difference in diameter between each successive section is about 4-6 millimeters. Also visible in FIG. 11 are swirl brakes 1112, 1114 and 1116 formed on the upstream end of the sections 1122, 1124 and 1126 respectively.

While the subject disclosure is described through the above embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A subsea fluid processing machine configured to process a multiphase subsea process fluid, the machine comprising:

a stationary machine body configured for deployment in a subsea location;

a multiphase fluid inlet and a multiphase fluid outlet, each formed at least partially within said machine body;

at least one rotating member configured to rotate about a vertically-oriented central axis thereby inducing a pressure differential of said multiphase process fluid between said inlet and outlet, and imparting a reactionary force on said rotating member in a downwards direction;

a rotating balance piston member in a fixed relationship with the rotating member including a first lower surface area exposed to a first volume of said multiphase process fluid and a second upper surface area exposed to a second volume of said multiphase process fluid, the first and second volumes configured such that while the rotating member is rotating, fluid pressure in said first volume is higher than in said second volume, thereby imparting a force on said rotating member in an upwards direction; and a balance piston fluid channel defined by an outer surface of said rotating balance piston member and an inner stationary surface in a fixed relationship with said stationary machine body, said balance piston fluid channel having a channel inlet to said first volume and a channel outlet to said second volume.

2. The machine according to claim 1 wherein the balance piston fluid channel is shaped so as to be reduce fluid-induced loads on the balance piston while in operation.

3. The machine according to claim 1 wherein the balance piston fluid channel has a diameter through the central axis that decreases in length from the channel inlet to the channel outlet.

4. The machine according to claim 3 wherein the balance piston channel comprises at first lower cylindrical section having a first diameter through the central axis, and a second upper cylindrical section having a second diameter through the central axis, wherein the first and second diameters are different.

5. The machine according to claim 4 wherein the second diameter is shorter than the first diameter by less than 20 mm.

6. The machine according to claim 5 wherein the second diameter is shorter than the first diameter by about 4-6 mm.

7. The machine according to claim 4 wherein the second diameter is longer than the first diameter by less than 20 mm.

8. The machine according to claim 4 wherein the balance piston chamber further comprises a third cylindrical section having a third diameter through the central axis that it shorter than said second diameter.

9. The machine according to claim 4 wherein the inner stationary surface and the outer surface of the balance piston each include first and second cylindrical sections corresponding to the diameters of the first and second sections of the balance piston channel.

10. The machine according to claim 9 wherein each of the first and second cylindrical sections of the inner stationary surface includes a plurality of cylindrical sub-sections having successively shorter diameters.

11. The machine according to claim 4 wherein the balance piston includes a ring-shaped cavity positioned between the first and second cylindrical sections.

12. The machine according to claim 11 wherein a swirl brake structure is formed within the ring-shaped cavity.

13. The machine according to claim 1 wherein a swirl brake structure is formed at the channel inlet of the balance piston channel.

14. The machine according to claim 13 where a second swirl brake structure is formed within the balance piston channel.

15. The machine according to claim 1 wherein the inlet of the balance piston channel and said first volume of said multiphase fluid form an integral part of a primary flow path from a final diffuser stage to the multiphase fluid outlet.

16. The machine according to claim 1 wherein the second volume is in fluid communication with said multiphase fluid inlet such that fluid pressures in said volume and said processing machine are about equal.

17. The machine according to claim 1 wherein the machine is a multiphase pump.

18. The machine according to claim 17 wherein the machine is a helico-axial multiphase pump.

19. The machine according to claim 1 where in the machine is a multiphase compressor.

20. The machine according to claim 1 wherein the balance piston forms an integral part of the rotating member.

21. The machine according to claim 1 wherein the balance piston is a solid sleeve mounted on an exterior surface of the rotating member.

22. The machine according to claim 1 wherein the balance piston is positioned above a plurality of impeller stages.

23. The machine according to claim 1 wherein the balance piston is positioned below a plurality of impeller stages.

24. A method of processing a multiphase fluid using a processing machine in a subsea location, the method comprising:

in a subsea location, rotating a rotating member about a vertically-oriented central axis within a stationary machine body thereby inducing a pressure differential between and machine inlet and a machine outlet, and imparting a reactionary force on said rotating member in a downwards direction; and rotating a balance piston in a fixed relationship with the rotating member including a first lower surface area exposed to a first volume of the multiphase fluid and a second upper surface area exposed to a second volume of the multiphase fluid, the first and second volumes configured such that as the pressure differential is induced a corresponding pressure differential is induced with said first volume fluid pressure being greater than said second volume fluid pressure, thereby imparting a counteracting force on said rotating member in an upwards direction.

25. The method according to claim 24 wherein the machine comprises a balance piston fluid channel defined by an outer surface of said rotating balance piston member and an inner stationary surface in a fixed relationship with said stationary machine body, said balance piston fluid channel having a channel inlet to said first volume and a channel outlet to said second volume.

26. The method according to claim 24 wherein the machine is a helico-axial design in which a plurality of rotating impeller stages are interleaved with a plurality of static diffuser stages.

27. The method according to claim 24 wherein the induced differential pressure between said machine inlet and outlet is greater than 100 bar.

28. The method according to claim 24 wherein the multiphase fluid has a gas volume fraction of greater than 20%.

29. The method according to claim 28 wherein the multiphase fluid has a gas volume fraction of greater than 40%.

30. The method according to claim 29 wherein the multiphase fluid has a gas volume fraction of greater than 50%.

31. The method according to claim 24 wherein the balance piston channel comprises at first lower cylindrical section having a first diameter through the central axis, and a second upper cylindrical section having a second diameter through the central axis, wherein the second diameter is shorter than the first diameter.

32. The method according to claim 31 wherein the second diameter is shorter than the first diameter by less than about 20 mm.

* * * * *